US010886062B2

(12) United States Patent
Lee

(10) Patent No.: US 10,886,062 B2
(45) Date of Patent: Jan. 5, 2021

(54) METHOD FOR PREPARING RARE-EARTH PERMANENT MAGNET

(71) Applicants: Hyundai Motor Company, Seoul (KR); Kia Motors Corporation, Seoul (KR)

(72) Inventor: Hyung Ju Lee, Gyeongsangnam-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 214 days.

(21) Appl. No.: 16/120,865

(22) Filed: Sep. 4, 2018

(65) Prior Publication Data

US 2019/0172637 A1 Jun. 6, 2019

(30) Foreign Application Priority Data

Dec. 1, 2017 (KR) ..... 10-2017-0163938

(51) Int. Cl.
*H01F 41/02* (2006.01)
*B22F 3/24* (2006.01)
(Continued)

(52) U.S. Cl.
CPC ..... *H01F 41/0293* (2013.01); *B22F 3/24* (2013.01); *B22F 9/04* (2013.01); *C22C 38/005* (2013.01); *H01F 1/057* (2013.01); *B22F 2003/241* (2013.01); *B22F 2003/248* (2013.01); *B22F 2201/10* (2013.01); *B22F 2201/20* (2013.01); *B22F 2202/05* (2013.01); *B22F 2301/355* (2013.01); *B22F 2998/10* (2013.01); *C22C 2202/02* (2013.01)

(58) Field of Classification Search
CPC combination set(s) only.
See application file for complete search history.

(56) References Cited

U.S. PATENT DOCUMENTS

2016/0284452 A1* 9/2016 Horikita ..... H01F 1/0577

FOREIGN PATENT DOCUMENTS

JP 2012043968 A * 3/2012
JP 5589667 B2 9/2014
(Continued)

OTHER PUBLICATIONS

JP2012043968A claims translated—Espacenet (Year: 2012).*
JP2012043968A description translated—Espacenet (Year: 2012).*

*Primary Examiner* — Anthony J Zimmer
*Assistant Examiner* — Ricardo D Morales
(74) *Attorney, Agent, or Firm* — Mintz Levin Cohn Ferris Glovsky and Popeo, P.C.; Peter F. Corless

(57) ABSTRACT

Disclosed is a method for preparing a rare-earth permanent magnet. The method includes: preparing an R-T-B-based sintered magnet; applying a first mixture including a light rare-earth element onto the surface of the R-T-B-based sintered magnet and diffusing the first mixture under a vacuum atmosphere to prepare a light rare-earth permanent magnet having the light rare-earth element diffused into a grain boundary; and applying a second mixture including a heavy rare-earth element onto the surface of the light rare-earth permanent magnet and diffusing the second mixture into the grain-boundary under a vacuum atmosphere to prepare a rare-earth permanent magnet.

9 Claims, 5 Drawing Sheets

(51) Int. Cl.

| | |
|---|---|
| ***B22F 9/04*** | (2006.01) |
| ***C22C 38/00*** | (2006.01) |
| ***H01F 1/057*** | (2006.01) |

(56) References Cited

FOREIGN PATENT DOCUMENTS

| | | | |
|---|---|---|---|
| JP | 5870522 | B2 | 3/2016 |
| KR | 10-1516567 | B1 | 5/2015 |

* cited by examiner

METHOD FOR PREPARING RARE-EARTH PERMANENT MAGNET

CROSS REFERENCE TO RELATED APPLICATION

The present application claims priority to Korean Patent Application No. 10-2017-0163938, filed Dec. 1, 2017, the entire contents of which is incorporated herein for all purposes by this reference.

TECHNICAL FIELD

The present invention relates to a method for preparing a rare-earth permanent magnet, in which a heavy rare-earth element may be diffused into grain-boundary of the permanent magnet. In particular, the method for preparing a rare-earth permanent magnet may improve the magnetic characteristic of the rare-earth permanent magnet by diffusing a light rare-earth element into the grain-boundary of the permanent magnet such that a heavy rare-earth element may be easily diffused, and then diffusing the heavy rare-earth element into the grain-boundary.

BACKGROUND

In general, a hybrid vehicle includes a vehicle that is driven by an efficient combination of two or more different types of power sources. For instance, the hybrid vehicle may be a vehicle that acquires a driving force through a fuel engine and an electric motor, and is referred to as a hybrid electric vehicle (HEV). Recently, the research has been actively conducted on hybrid vehicles in response to the demands for the improvement of fuel efficiency and the development of environment-friendly products.

Such a hybrid vehicle includes an engine and electric motor as power sources. The electric motor is driven by power supplied from a battery mounted in the vehicle, and includes a stator and rotor as main components like a typical motor. The stator may be configured by winding a coil around a stator core, and the rotor may be disposed in the stator and configured by inserting a permanent magnet into a rotor core.

The above-described electric motor for vehicles may require a high-performance permanent magnet in order to acquire high power and high efficiency.

Therefore, a rare-earth permanent magnet such as an NdFeB sintered magnet, which has a magnetic force three to five times greater than a conventional ferrite magnet, may be used to reduce the weight of the motor while improving the efficiency of the vehicle.

The magnetic characteristic of the rare-earth permanent magnet may include a residual magnetic flux density (Br), coercive force (HcJ) and the like. The residual magnetic flux density may be determined by the major phase fraction, density and magnetic orientation degree of the rare-earth permanent magnet, and the coercive force may be related to the microstructure of the rare-earth permanent magnet and determined by a reduction in size of crystal grains or uniform distribution of crystal grain boundary phases.

In the related art, a technique for reducing the sizes of grains for preparing the rare-earth permanent magnet has been developed in order to improve the coercive force. However, the size reduction of the grains may not only increase the degree of oxidation, but also increase the manufacturing cost. Therefore, the grain size may not be unlimitedly reduced.

Furthermore, since the rare-earth permanent magnet exhibits high conductivity and low specific resistance, an eddy current may be easily generated in the rare-earth permanent magnet. In this case, the temperature of the permanent magnet may increase, which may reduce the magnetic flux density or easily cause irreversible demagnetization of the rare-earth permanent magnet. The reduction of the magnetic flux density or the irreversible demagnetization may significantly degrade the motor performance.

In order to solve the above-described problem in the related art, a technique for grain-boundary diffusing a heavy rare-earth element such as dysprosium (Dy) or terbium (Tb) has been developed to improve the coercive force of the conventional rare-earth permanent magnet which had been prepared through sintering.

However, since the expensive heavy rare-earth element may not be smoothly diffused into the grain boundary during the grain boundary diffusion, the magnetic characteristic of the rare-earth permanent magnet may not be sufficiently improved. Furthermore, the consumption of the heavy rare-earth element used during the grain boundary diffusion may considerably increase the manufacturing cost.

The foregoing is intended merely to aid in the understanding of the background of the present invention, and is not intended to mean that the present invention falls within the purview of the related art that is already known to those skilled in the art.

SUMMARY OF THE INVENTION

In preferred aspects, the present invention provides a method for preparing a rare-earth permanent magnet. In one preferred aspect, a heavy rare-earth element may be diffused smoothly, thereby improving the magnetic characteristic of the permanent magnet, such as a coercive force or residual magnetic flux.

In addition, in one preferred aspect, the method for preparing a rare-earth permanent magnet may reduce a manufacturing cost by minimizing the consumption of a heavy rare-earth element.

In one aspect, provided is a method for preparing a rare-earth permanent magnet. The method may include: preparing an R-T-B-based sintered magnet; applying a first mixture including a light rare-earth element onto the surface of the R-T-B-based sintered magnet to prepare a light rare-earth permanent magnet preferably having the light rare-earth element diffused into a grain boundary; and applying a second mixture including a heavy rare-earth element onto the surface of the light rare-earth permanent magnet to prepare a rare-earth permanent magnet.

Preferably, light rare-earth element may diffuse into a grain boundary of the R-T-B sintered magnet. This diffusing may suitably occur under reduced atmosphere (vacuum) conditions. Also preferably, the heavy rare-earth element may diffuse into (such as a grain boundary of) the light rare-earth permanent magnet. The diffusing also may suitably occur under reduced atmosphere (vacuum) conditions.

The R-T-B-based sintered magnet may be prepared by steps including: preparing an R-T-B-based alloy ingot by melting an R-T-B-based alloy; preparing an R-T-B-based alloy powder having an average grain size of 5.0 μm or less (excluding zero) by grinding the R-T-B-based alloy ingot; preparing an R-T-B-based green body by subjecting the R-T-B-based alloy powder to magnetic field forming under an inert atmosphere; and preparing the R-T-B-based sintered magnet by sintering the R-T-B-based green body.

The light rare-earth permanent magnet may be prepared by steps including: preparing the first mixture by mixing a light rare-earth compound with a solvent; applying the first mixture onto the surface of the R-T-B-based sintered magnet; and inserting the R-T-B-based sintered magnet having the first mixture applied thereon into a heating furnace under a vacuum atmosphere such that the first mixture is diffused into the grain-boundary.

The term "R-T-B-based" as used herein refers to a material mainly including at least one rare-earth elements (R), at least one transition metal (T), boron (B), and residual Fe and other inevitable impurities.

Preferably, the light rare-earth compound may include NdF or NdH, and the solvent may include alcohol.

The light rare-earth permanent magnet may suitably be prepared by diffusing the light rare-earth mixture under a vacuum atmosphere at a temperature of about 800 to 1,000° C. for about 1 to 30 hours.

The method may further include, after the first mixture is diffused, cooling the light rare-earth permanent magnet under an inert atmosphere; and removing stress of the light rare-earth permanent magnet by heat-treating the light rare-earth permanent magnet at a temperature of about 400 to 600° C. under an inert atmosphere for about 1 to 3 hours.

The rare-earth permanent magnet may be prepared by steps including preparing the second mixture including the heavy-rare-earth element by mixing a rare-earth compound with a solvent; applying the second mixture onto the surface of the light rare-earth permanent magnet; and inserting the rare-earth permanent magnet having the second mixture applied thereon into a heating furnace under a vacuum atmosphere such that the second mixture is diffused into the grain-boundary.

Preferably, the heavy rare-earth compound may include TbF or TbH, and the solvent may include alcohol.

The rare-earth permanent magnet may suitably be prepared by diffusing the second mixture under a vacuum atmosphere at a temperature of about 800 to 1,000° C. for about 1 to 30 hours.

The method may further include, after the second mixture is diffused, cooling the rare-earth permanent magnet under an inert atmosphere; and removing stress of the rare-earth permanent magnet by heat-treating the rare-earth permanent magnet at a temperature of about 400 to 600° C. under an inert atmosphere for about 1 to 3 hours.

Further provided is a vehicle that may include the rare-earth permanent magnet prepared by the method described herein.

Other aspect of the inventions are disclosed infra.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
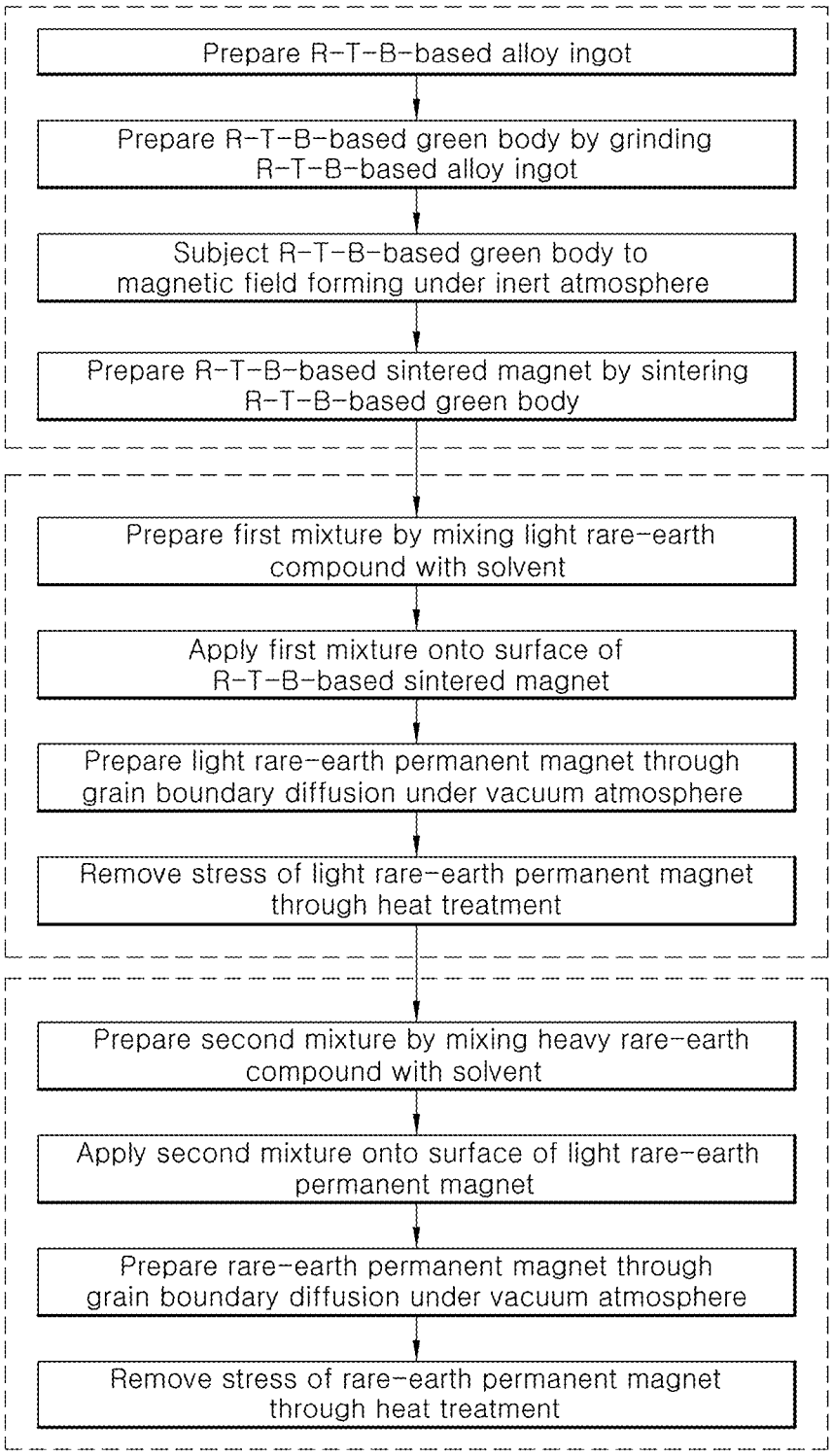
FIG. 1 is a flowchart illustrating an exemplary method for preparing a rare-earth permanent magnet according to an embodiment of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprise", "include", "have", etc. when used in this specification, specify the presence of stated features, regions, integers, steps, operations, elements and/or components but do not preclude the presence or addition of one or more other features, regions, integers, steps, operations, elements, components, and/or combinations thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereafter, exemplary embodiments of the present invention will be described in detail with reference to the accompanying drawings, but the present invention is not limited by the embodiments. For reference, like reference numerals represent the same elements. Under such a rule, elements illustrated in one drawing can be described with reference to contents described in other drawings, and contents determined to be obvious to those skilled in the art or duplicated contents can be omitted.

The present invention provides a method for preparing a rare-earth permanent magnet. Preferably, the method ma include primarily diffusing a light rare-earth element into the grain boundary of an R-T-B-based sintered magnet, and then secondarily diffusing a heavy rare-earth element to substitute the light rare-earth element diffused into the grain boundary with the heavy rare-earth element. The method can maximize the content of the heavy rare-earth element in the grain boundary of the prepared rare-earth permanent magnet, thereby improving the magnetic characteristic of the prepared rare-earth permanent magnet, such as a coercive force and residual magnetic flux density.

Figure 2:
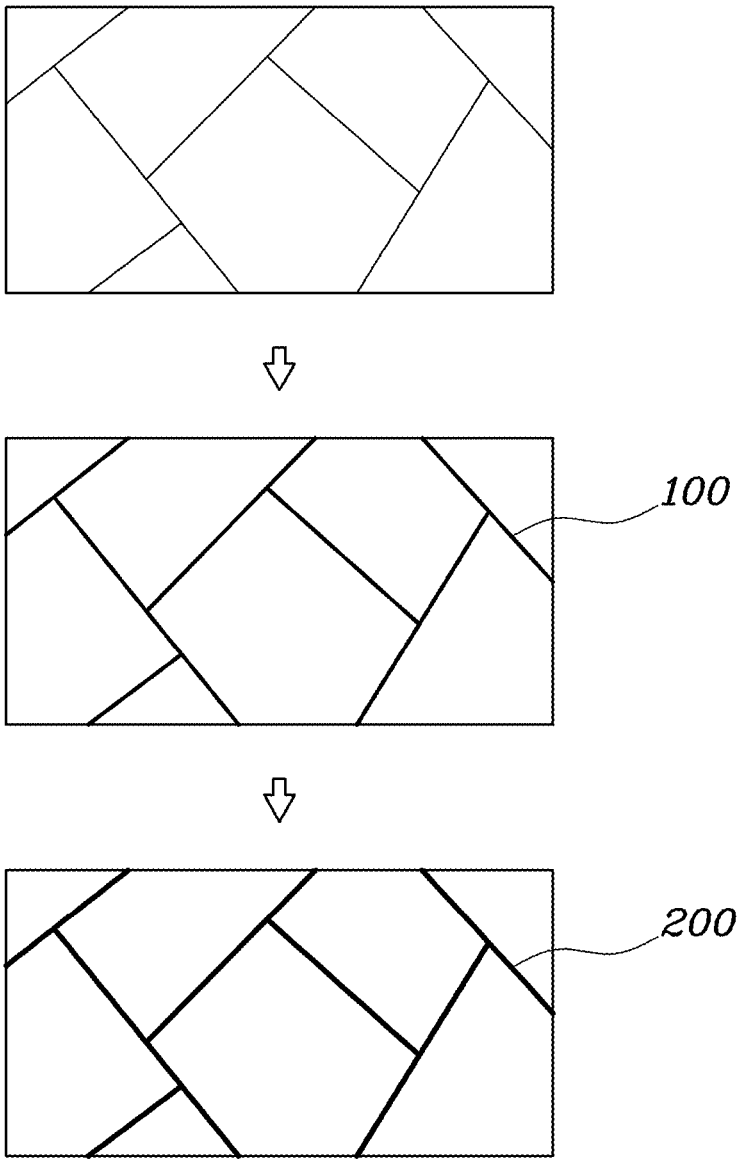
FIG. 2 is a schematic view for describing a grain boundary diffusion step in an exemplary method according to an embodiment of the present invention.

FIG. 1 is a flowchart illustrating an exemplary method for preparing an exemplary rare-earth permanent magnet according to an exemplary embodiment of the present invention, and FIG. 2 is a schematic view illustrating a grain boundary diffusion step in an exemplary method according to an exemplary embodiment of the present invention.

As illustrated in FIGS. 1 and 2, the method for preparing a rare-earth permanent magnet according to the exemplary embodiment of the present invention may include a preparation step of preparing a R-T-B-based sintered magnet, a first grain boundary diffusion step of forming a light rare-earth rich phase 100 in a grain boundary of the R-T-B-based sintered magnet by grain-boundary diffusing a light rare-earth element into the grain boundary, and a second grain boundary diffusion step of substituting the diffused light rare-earth element with a heavy-earth permanent magnet, thereby preparing the rare-earth permanent magnet having the heavy rare-earth rich phase 200 in the grain boundary.

The preparation step according to the embodiment of the present invention may include: an alloy preparation step of preparing an R-T-B-based alloy ingot by strip casting an R-T-B-based alloy, a grinding process of preparing an R-T-B-based alloy powder by grinding the R-T-B-based alloy ingot, a forming process of preparing an R-T-B-based green body by subjecting the R-T-B-based alloy powder to magnetic field forming, and a sintering process of preparing an R-T-B-based sintered magnet by sintering the R-T-B-based green body.

The alloy preparation process according to the embodiment of the present invention may include preparing the R-T-B-based alloy ingot by melting ferro-boron, rare-earth metal such neodymium (Nd) or dysprosium (Dy) in 99 wt % of purity, copper (Cu) and steel (Fe). Preferably, the R-T-B-based alloy ingot may include an amount of about 20 to 30 wt % of R (rare-earth element), an amount of about 0 to 5 wt % of T (transition metal), an amount of about 0 to 2 wt % of B (boron), residual Fe and other inevitable impurities. All the wt % are based on the total weight of the R-T-B-based alloy ingot.

The R-T-B-based alloy ingot may be prepared under a vacuum atmosphere. Because the vacuum atmosphere may minimize the oxygen content of the rare-earth magnet ingot and easily diffuse a light rare-earth element and a heavy rare-earth element afterwards, the magnetic characteristic of the prepared rare-earth permanent magnet may be improved.

When the R-T-B-based alloy ingot is prepared, the R-T-B-based alloy ingot may be exposed to hydrogen gas so as to react with the hydrogen gas during the grinding process. Then, the R-T-B-based alloy ingot may be vacuum-exhausted and heated to a temperature of about 500° C. such that the hydrogen gas may be partially discharged. Then, a jet-mill using cooling and high-pressure nitrogen may be used to prepare the R-T-B-based alloy powder.

The R-T-B-based alloy ingot may be ground in such a manner that the R-T-B-based alloy powder may have an average particle size equal to or less than about 5.0 μm. Accordingly, the reduction in sizes of grains in the prepared rare-earth permanent magnet may improve a magnetic characteristic such as a coercive force.

When the R-T-B-based alloy powder is prepared, the R-T-B-based green body may be prepared by mixing the R-T-B-based alloy powder with a lubricant during the forming process. Then, the R-T-B-based green body may be prepared through a magnetic field forming process with an external magnetic field of 3T and a pressure of 1 ton/cm under an inert atmosphere.

When the R-T-B-based green body is prepared, the R-T-B-based green body may be sintered at a temperature of about 1,080° C. in a sintering furnace under a vacuum or inert atmosphere for about four hours at the sintering process. Then, the sintered body may be heat-treated for about two hours at each of temperatures of about 850, 550 and 500° C., in order to prepare the R-T-B-based sintered magnet.

When the R-T-B-based sintered magnet is prepared, a light rare-earth permanent magnet may be prepared by diffusing a light rare-earth element into the grain boundary of the R-T-B-based sintered magnet at the first grain boundary diffusion step, and a rare-earth permanent magnet is prepared by substituting the light rare-earth element present in the grain boundary of the light rare-earth permanent magnet with a heavy rare-earth element at the second grain boundary diffusion step.

Preferably, the first grain boundary diffusion step according to an exemplary embodiment of the present invention may include preparing a first mixture including the light rare-earth element, applying the first mixture and diffusing the first mixture.

In the present embodiment, the first mixture may be prepared by mixing a light rare-earth compound with a solvent. The light rare-earth compound may include, but not limited to, NdF or NdH, ethanol may be used as the solvent, and the first mixture may be prepared in a slurry state by mixing the light rare-earth compound with the solvent at a mass ratio of about 1:1. Other suitable light rare-earth compounds includes, for example, lanthanum (La), cerium (Ce), praseodymium (Pr), promethium (Pm), or compounds thereof with other non-metallic elements such as F, H, N or O. In general, as referred to herein, a light rare-earth compound will contain a rare-earth element having an atomic number of 57 to 61.

During applying the first mixture, the slurry-state first mixture may be applied onto the surface of the R-T-B-based sintered magnet. Then, during diffusing the first mixture, the R-T-B-based sintered magnet having the first mixture applied thereon may be inserted into a heating furnace such that the first mixture may be diffused into the grain-boundary diffused under a vacuum atmosphere.

Preferably, the first mixture diffusion process may be performed at a temperature of about 800 to 1,000° C. for about 1 to 30 hours.

Since the light rare-earth element is not smoothly diffused at a temperature of less than about 800° C. and the grains of the R-T-B-based sintered magnet may grow at a temperature of greater than about 1,000° C., the coercive force may be reduced.

The first diffusion step according to the embodiment of the present invention may further include a first cooling process of cooling the light rare-earth permanent magnet after the first mixture diffusion process and a first heat treatment process of removing stress of the light rare-earth permanent magnet by heat-treating the cooled light rare-earth permanent magnet.

Preferably, the first cooling process may include rapidly cooling the light rare-earth permanent magnet prepared by subjecting the light rare-earth element to grain boundary diffusion under an inert atmosphere, and the first heat treatment process may include removing residual stress in the light rare-earth permanent magnet by heat-treating the cooled light rare-earth permanent at a temperature of about 400 to 600° C. under an inert atmosphere for about 1 to 3 hours.

At this time, when the heat treatment is performed at a temperature of less than about 400° C., it may take quite a long time to remove stress, thereby lowering the productivity. Furthermore, when the heat treatment is performed at a temperature greater than about 600° C., the distribution of the light rare-earth element diffused into the grain boundary may be changed to degrade the magnetic characteristic such as a coercive force. Therefore, the temperature may be limited to the above-described range.

As described above, when the light rare-earth permanent magnet having a high concentration of light rare-earth element in the grain boundary is prepared by diffusing the light rare-earth element through the first diffusion step, the rare-earth permanent magnet may be prepared by diffusing the heavy rare-earth element into the light rare-earth permanent magnet through the second diffusion step.

The second diffusion step according to an exemplary embodiment of the present invention may include preparing a second mixture including the heavy rare-earth element, applying the second mixture and diffusing the second mixture. In particular, the light rare-earth element present in the grain boundary of the light rare-earth permanent magnet may be substituted with the heavy rare-earth element, when the second mixture is applied onto the surface of the light rare-earth permanent magnet.

In the present embodiment, the heavy rare-earth mixture may be prepared by mixing a heavy rare-earth compound with a solvent. The heavy rare-earth compound may include, but not limited to, TbF or TbH, ethanol may be used as the solvent, and the second mixture may be prepared in a slurry state by mixing the heavy rare-earth compound with the solvent at a mass ratio of about 1:1. Other suitable heavy rare-earth compounds include, for example, europium (Eu), gadolinium (Gd), dysprosium (Dy), holmium (Ho), erbium (Er), thulium (Tm), ytterbium (Yb) and lutetium (Lu), or compounds thereof with other non-metallic elements such as F, H, N or O. In general, as referred to herein, a heavy rare-earth compound will contain a rare-earth element having an atomic number greater than 62.

During the heavy rare-earth mixture application process, the slurry-state heavy rare-earth mixture may be applied onto the surface of the light rare-earth permanent magnet. During diffusing the second mixture, the light rare-earth permanent magnet having the second mixture applied thereon may be inserted into the heating furnace and grain boundary-diffused under a vacuum atmosphere.

The second mixture application process and the second mixture diffusion process may be performed under the same conditions as the first mixture application process and the first mixture diffusion process, because of the same reason as the light rare-earth mixture application process and the light rare-earth mixture diffusion process.

The second diffusion step according to an exemplary embodiment of the present invention may also further include a second cooling process of cooling the rare-earth permanent magnet after the second mixture diffusion process and a second heat treatment process of removing stress of the rare-earth permanent magnet by heat-treating the cooled rare-earth permanent magnet.

Preferably, the second cooling process and the second heat treatment process may be performed under the same conditions as the first cooling process and the first heat treatment process, because of the same reason as the first cooling process and the first heat treatment process.

Figure 3:
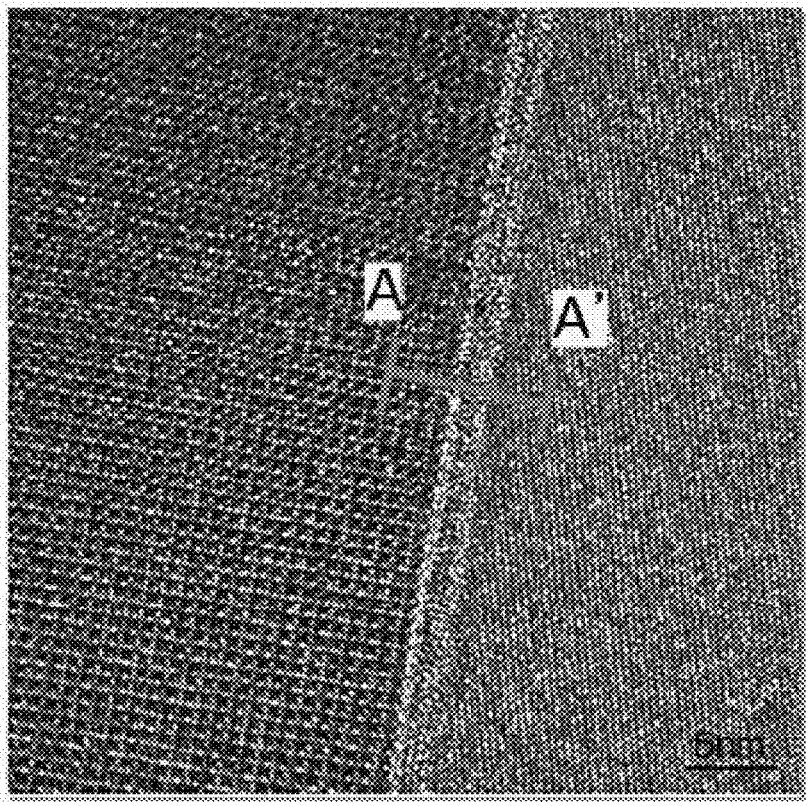
FIG. 3 is a photograph for describing a grain boundary of an exemplary rare-earth permanent magnet according to an embodiment of the present invention.
Figure 4:
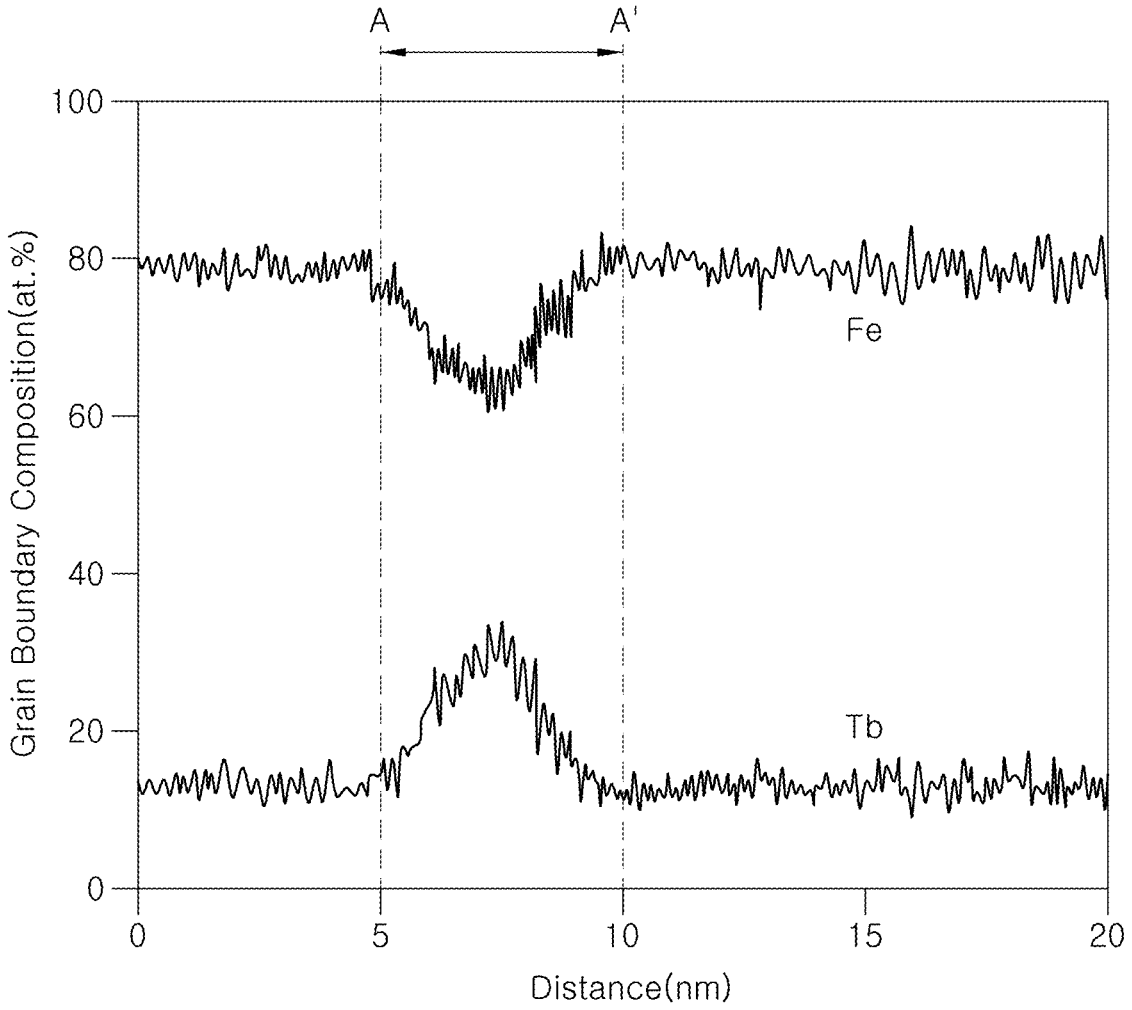
FIG. 4 is a graph illustrating a grain boundary composition of a rare-earth permanent magnet prepared by a conventional grain boundary diffusion method.
Figure 5:
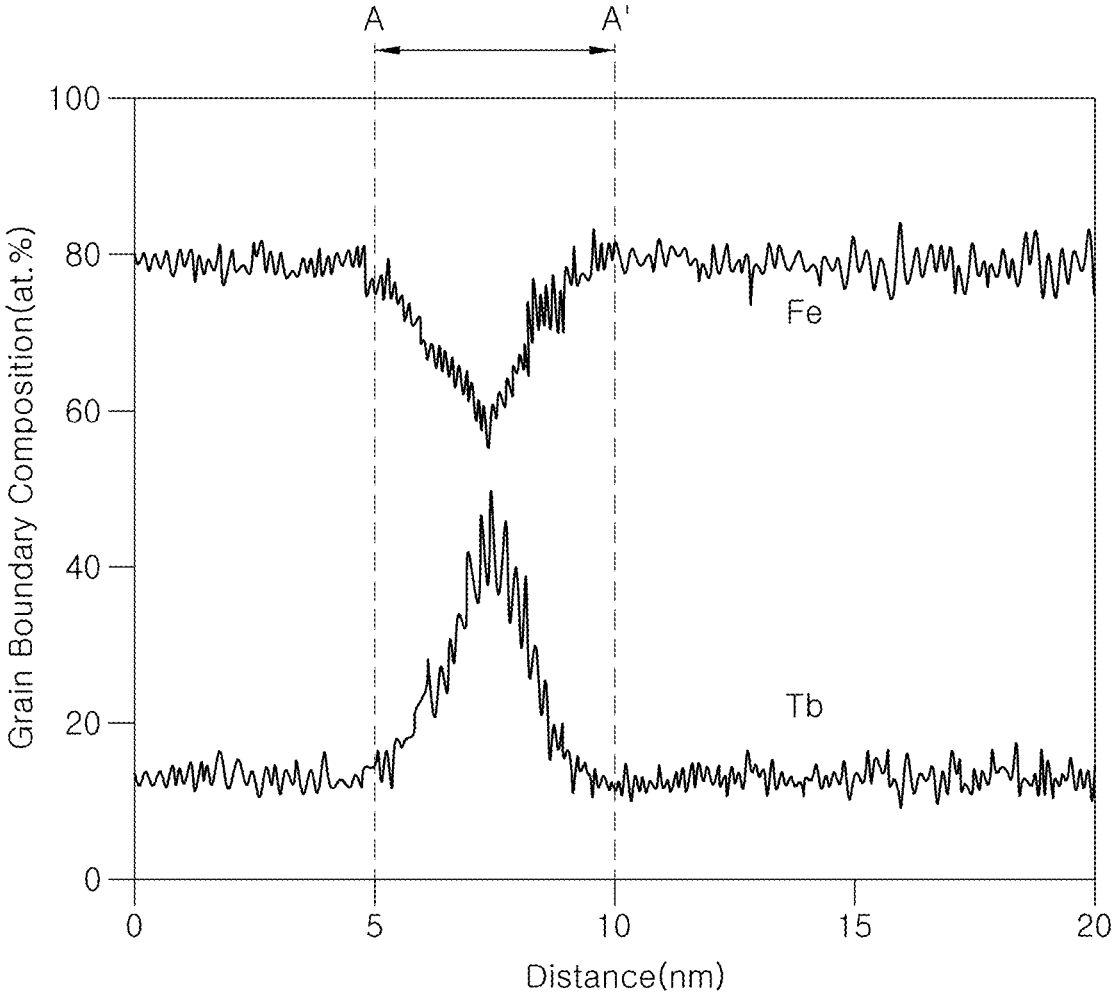
FIG. 5 is a graph illustrating a grain boundary composition of an exemplary rare-earth permanent magnet prepared by the method according to an embodiment of the present invention.

FIG. 3 is a photograph for describing the grain boundary of the rare-earth permanent magnet, FIG. 4 is a graph illustrating a grain boundary composition of a rare-earth permanent magnet prepared by a conventional grain boundary diffusion method, and FIG. 5 is a graph illustrating a grain boundary composition of the rare-earth permanent magnet according to an exemplary embodiment of the present invention.

As illustrated in FIGS. 3 to 5, the content of the heavy rare-earth element in the grain boundary in the rare-earth permanent magnet prepared by the conventional grain boundary diffusion method is 30 at %, but the content of the heavy rare-earth element in the grain boundary in the rare-earth permanent magnet prepared by the method according to an exemplary embodiment of the present invention is 60 at %. The grain boundary efficiency of the heavy rare-earth element in the method according to the embodiment of the present invention has been significantly improved.

Hereafter, various embodiments and comparative examples of the present invention will be described.

TABLE 1

| | | | Magnetic characteristic | |
|---|---|---|---|---|
| Classification | Light rare-earth compound | Heavy rare-earth compound | Residual magnetic flux (kG) | Coercive force (kOe) |
| First comparative example | — | — | 13.28 | 17.05 |
| Second comparative example | NdF | — | 13.29 | 18.24 |
| Third comparative example | NdH | — | 13.30 | 18.68 |
| Fourth comparative example | — | TbF | 13.25 | 23.56 |
| Fifth comparative example | — | TbH | 13.28 | 24.06 |
| Sixth comparative example | Y | TbF | 13.22 | 25.03 |
| Seventh comparative example | Y | TbH | 13.25 | 25.54 |
| Eighth comparative example | NdOF | TbF | 12.29 | 24.46 |
| Ninth comparative example | NdOF | TbH | 13.01 | 25.02 |
| First embodiment | NdF | TbF | 13.31 | 26.68 |
| Second embodiment | NdF | TbH | 13.29 | 27.36 |
| Third embodiment | NdH | TbF | 13.33 | 27.09 |
| Fourth embodiment | NdH | TbH | 13.26 | 27.96 |

Table 1 shows the magnetic characteristics of various comparative examples and embodiments which were prepared by applying different types of light and heavy rare-earth compounds under the same diffusion condition.

As shown in Table 1, the first comparative example subjected to grain boundary diffusion exhibited improved magnetic characteristic than the other comparative examples and embodiments.

The fourth and fifth comparative examples in which heavy rare-earth elements were grain boundary-diffused maintained the same level of residual magnetic flux density as the second and third comparative examples in which light rare-earth elements were grain boundary-diffused, but had substantially improved coercive force than the second and third comparative examples.

In each of the sixth to ninth comparative examples and the first to fourth embodiments, a light rare-earth element was diffused to form a light rare-earth rich phase 100 in the grain boundary, and a heavy rare-earth element was diffused to form a heavy rare-earth rich phase 200, in order to a prepare rare-earth permanent magnet.

The sixth to ninth comparative examples and the first to fourth embodiments show that, when NdH or NdF was used as the light rare-earth compound, the residual magnetic flux density was maintained at a similar level to when NdOF or Y was used as the light rare-earth compound, but the coercive force was improved greater than when NdOF or Y was used as the light rare-earth compound, which means that the magnetic characteristic has been improved.

As described above, the method for preparing a rare-earth permanent magnet according to various exemplary embodiments of the present invention may increase the content of the light rare-earth compound such as Nd in the grain boundary by performing the primary grain boundary diffusion using the light rare-earth compound such as NdF or NdH at the first grain boundary diffusion step, and substitute the light rare-earth element in the grain boundary with the heavy rare-earth element such as Tb by performing the secondary grain boundary diffusion using the heavy rare-earth compound such as TbF or TbH at the second grain boundary step, thereby improving magnetic characteristic of the rare-earth permanent magnet.

The light rare-earth element escaping from the grain boundary during the substitution process may be discharged to the outside of the rare-earth permanent magnet, and a post-treatment process such as surface polishing after the second grain boundary diffusion step may be performed to remove the light rare-earth element remaining on the surface of the rare-earth permanent magnet while the light rare-earth element may be substituted with the heavy rare-earth element and discharged to the outside of the rare-earth permanent magnet at the second grain boundary diffusion step.

According to various exemplary embodiments of the present invention, the method can smoothly diffuse the heavy rare-earth element of the rare-earth permanent magnet into the grain boundary, and increase the amount of the heavy rare-earth element diffused into the rare-earth permanent magnet, thereby improving the magnetic characteristic such as a coercive force and residual flux density.

Furthermore, the method may minimize the consumption of the heavy rare-earth element in comparison to a rare-earth permanent magnet having the same magnetic characteristic, thereby reducing the manufacturing cost.

Although various preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method for preparing a rare-earth permanent magnet, comprising:

preparing an R-T-B-based sintered magnet, wherein the R-T-B-based sintered magnet comprises an amount of about 20 to 30 wt % of rare-earth element (R), an amount of about 0 to 5 wt % of transition metal (T), an amount of about 0 to 2 wt % of boron (B), residual Fe and other inevitable impurities;

applying a first mixture comprising a light rare-earth element onto the surface of the R-T-B-based sintered magnet and diffuses the first mixture into a grain boundary of the R-T-B sintered magnet to prepare a light rare-earth permanent magnet having the light rare-earth element; and applying a second mixture comprising a heavy rare-earth element onto the surface of the light rare-earth permanent magnet and diffuses heavy rare-earth element into a grain boundary of the light rare-earth permanent magnet to prepare the rare-earth permanent magnet, wherein the light rare-earth permanent magnet is prepared by steps comprising:

preparing the first mixture comprising the light rare-earth element by mixing a light rare-earth compound with a solvent;

applying the first mixture onto the surface of the R-T-B-based sintered magnet; and inserting the R-T-B-based sintered magnet having the first mixture applied thereon into a heating furnace under a vacuum atmosphere such that the first mixture is diffused into the grain-boundary, wherein the light rare-earth compound comprises NdH, and the solvent comprises alcohol.

2. The method of claim 1, wherein the R-T-B-based sintered magnet are prepared by steps comprising:

preparing an R-T-B-based alloy ingot by melting an R-T-B-based alloy;

preparing an R-T-B-based alloy powder having an average grain size of about 5.0 μm or less (excluding zero) by grinding the R-T-B-based alloy ingot;

preparing an R-T-B-based green body by subjecting the R-T-B-based alloy powder to magnetic field forming under an inert atmosphere; and preparing the R-T-B-based sintered magnet by sintering the R-T-B-based green body.

3. The method of claim 1, wherein the light rare-earth permanent magnet is prepared by diffusing the first mixture under a vacuum atmosphere at a temperature of about 800 to 1,000° C. for about 1 to 30 hours.

4. The method of claim 1, further comprising, after the first mixture is diffused:

cooling the light rare-earth permanent magnet under an inert atmosphere; and removing stress of the light rare-earth permanent magnet by heat-treating the light rare-earth permanent magnet at a temperature of about 400 to 600° C. under an inert atmosphere for about 1 to 3 hours.

5. The method of claim 1, wherein the rare-earth permanent magnet is prepared by steps comprising:

preparing the second mixture comprising the heavy rare-earth element by mixing a rare-earth compound with a solvent;

applying the second mixture onto the surface of the light rare-earth permanent magnet; and inserting the rare-earth permanent magnet having the second mixture applied thereon into a heating furnace under a vacuum atmosphere such that the second mixture is diffused into the grain-boundary.

6. The method of claim 5, wherein the heavy rare-earth compound comprises TbF or TbH, and the solvent comprises alcohol.

7. The method of claim 5, wherein the rare-earth permanent magnet is prepared by diffusing the second mixture under a vacuum atmosphere at a temperature of about 800 to 1,000° C. for about 1 to 30 hours.

8. The method of claim 5, further comprising, after the second mixture is diffused:

cooling the rare-earth permanent magnet under an inert atmosphere; and removing stress of the rare-earth permanent magnet by heat-treating the rare-earth permanent magnet at a temperature of about 400 to 600° C. under an inert atmosphere for about 1 to 3 hours.

9. A vehicle comprising a rare-earth permanent magnet prepared by a method of claim 1.

* * * * *